United States Patent [19]

Lawless

[11] Patent Number: 4,862,610

[45] Date of Patent: Sep. 5, 1989

[54] ARTISTS WATERCOLOR PAPER STRETCHING BOARD

[76] Inventor: Glen D. Lawless, P.O. Box 1895, Bandera, Tex. 78003

[21] Appl. No.: 144,337

[22] Filed: Jan. 15, 1988

[51] Int. Cl.[4] ..... D06C 3/08

[52] U.S. Cl. ..... 38/102.91; 40/156; 403/387

[58] Field of Search ..... 38/102.2, 102.91; 206/1.7; 118/503; 40/156; 160/378; 403/386, 387, 408.1; 52/511, 476, 127.8

[56] References Cited

U.S. PATENT DOCUMENTS

| | | | |
|---|---|---|---|
| 1,895,309 | 1/1933 | Boomershine | 38/102.91 |
| 2,704,906 | 3/1955 | Amado | 38/102.91 X |
| 2,832,171 | 4/1958 | Batey | 38/102.91 |
| 4,126,952 | 11/1978 | Weisfield et al. | 40/156 |
| 4,204,350 | 5/1980 | Brenner | 40/156 |
| 4,277,901 | 7/1981 | Williams | 38/102.2 |
| 4,660,308 | 4/1987 | Dang et al. | 38/102.91 X |

FOREIGN PATENT DOCUMENTS

| | | | |
|---|---|---|---|
| 16940 | 1/1913 | Denmark | 40/156 |

*Primary Examiner*—Andrew M. Falik

[57] ABSTRACT

Watercolor paper is water expanded and placed on the surface of the watercolor paper constrainer for drying and use by the artist. The watercolor paper constrainer consists of a rectangular base defined by constraining straps and tightening screws capable of constraining industry-standard size watercolor paper at the edge-line to obtain a fully flat sheet for full-format painting.

2 Claims, 3 Drawing Sheets

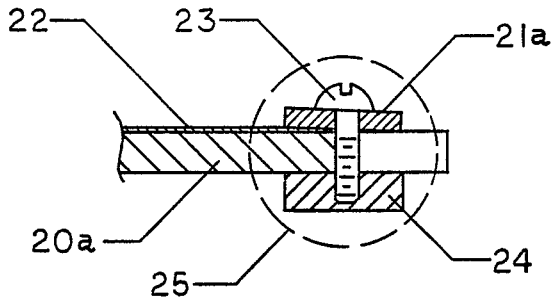
FIGURE 5
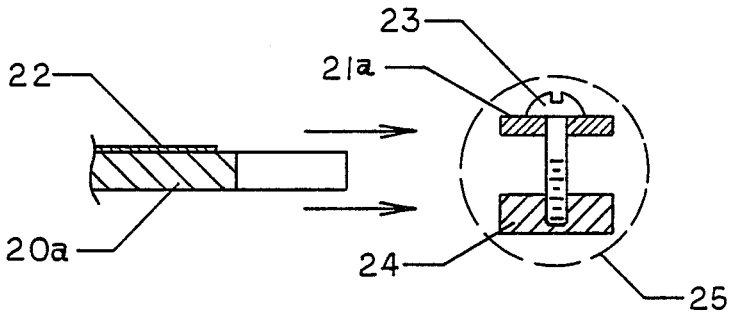
FIGURE 6
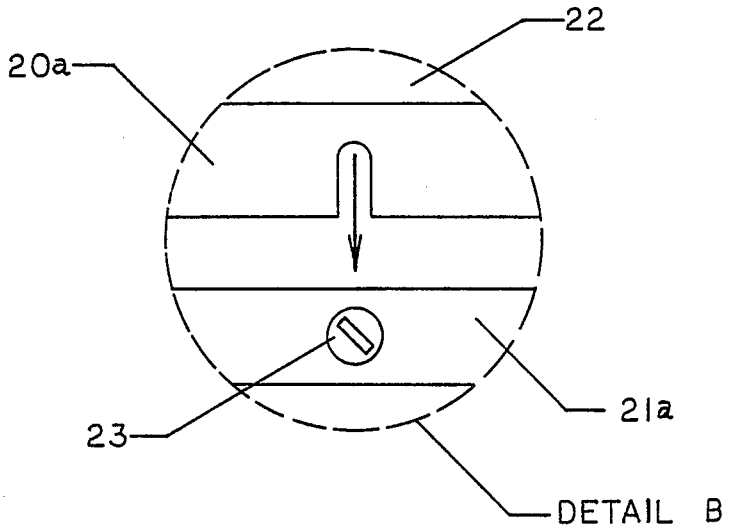
DETAIL 7

ARTISTS WATERCOLOR PAPER STRETCHING BOARD

BRIEF SUMMARY OF THE INVENTION

Watercolor paper, used by watercolor artists, is by requirement a strong, tough material that expands when wetted, and contracts with great foce when allowed to dry. Since wetted unconstrained watercolor paper does not return to its original flatness upon drying, the contraction creates hills and valleys which render it unacceptable for the artist in the attempt to control the process of applying the wet pigment.

The commonly employed methods for maintaining flatness of the watercolor paper surface vary from using tacks, tape, gluded backing, and other means, all of which are troublesome, and most often not successful.

The invention offers a useful tool to the watercolor artist, a tool that embodies the means by which a sheet of industry-standard size watercolor paper, being water expanded and clamped in the constrainer, will obtain a full-format painting by developing edge-line constraint and maintaining a flat sheet throughout the full surface.

DETAILED DESCRIPTION

There is a base 20 composed of material which is sufficiently strong and water resistant to withstand repeated wetting and still resist warping and deterioration. This base 20 may be composed of solid treated wood, treated plywood, composite board of wood or other organic products, inorganic material such as plastic or metal, or a combination of these.

Figure 1:
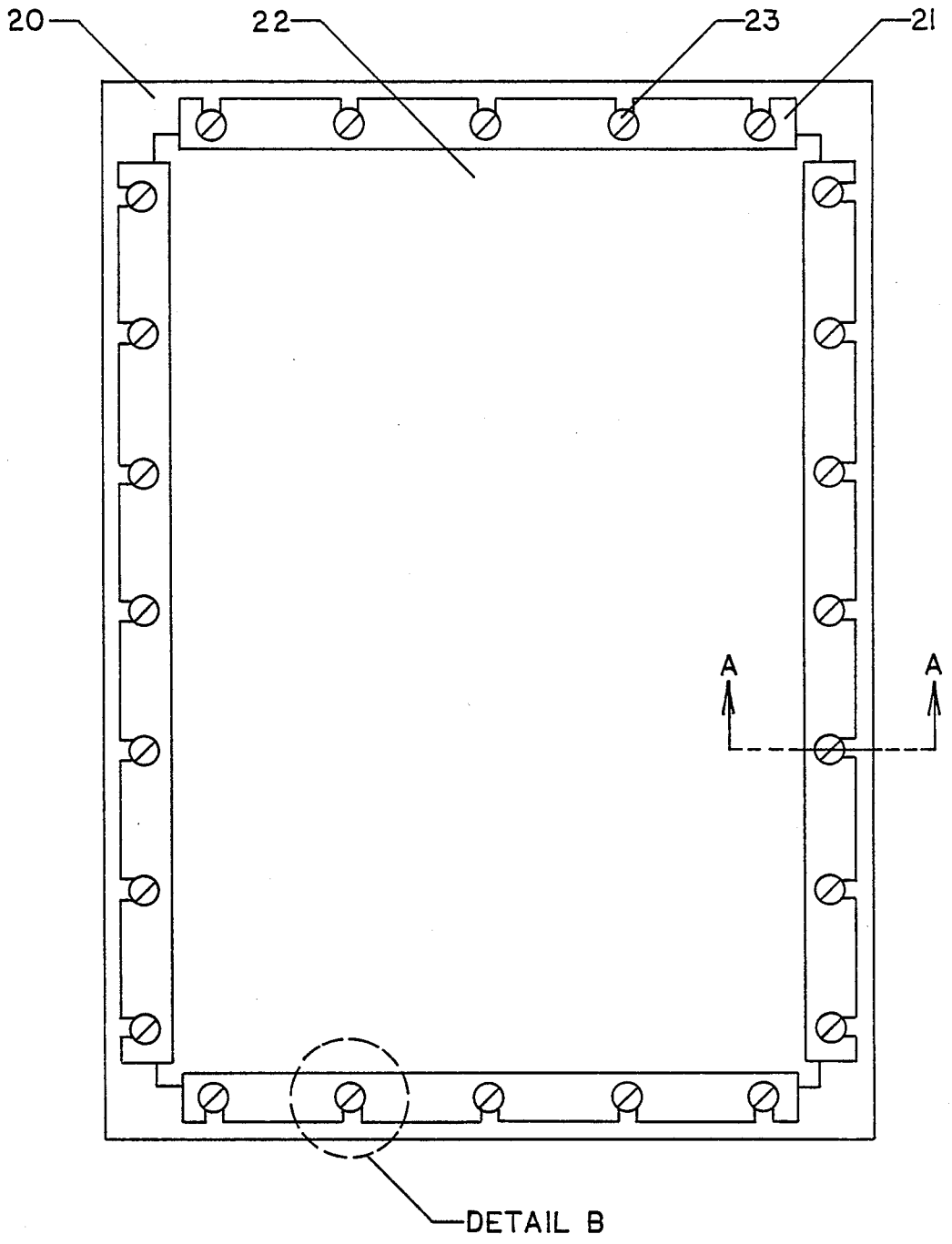
FIG. 1 is a top view of the watercolor paper constrainer with the watercolor paper in place.
Figure 2:
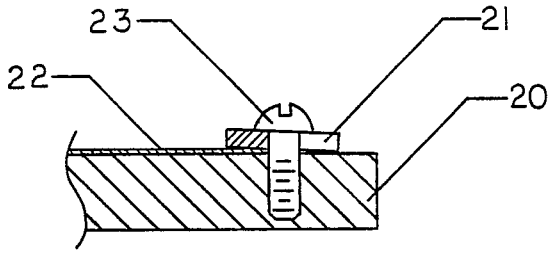
FIG. 2 is a top detail edge view looking downward showing constraining strap slid inward, free of the screws, releasing the edge-line of the watercolor paper for removal.

The constraining strap 21 is composed of metal, plastic or other high-strength material such as aluminum sufficiently strong to withstand considerable stress required to constrain the watercolor paper 22. The screw 23 serve to draw the strap 21 into intimate contact with the watercolor paper 22 and the base 20. As shown in FIGS. 1 and 2 it is noted that constraining strap 21, whose lengths approximate a base side, is open slotted at its edge for adjustment to constrain the edge-line of the watercolor paper 22, and for removal and release of the watercolor paper 22, and that the screw 23 is permanently mounted in the edge of the base 20, with mating threads unitized with the base 20 at proper intervals to mate with the slots in the strap 21.

Figure 3:
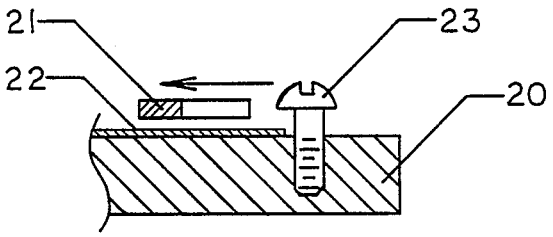
FIG. 3 is a top detail edge view of the alternate design showing constraining assembly slid outward off the board, releasing the watercolor paper for removal.
Figure 4:
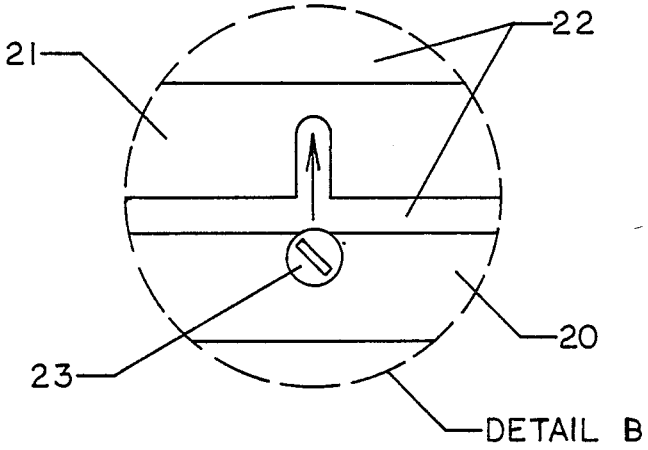

An alternate design, FIG. 3 shows a base 20A having slots in the edge of base 20A with constraining assembly 21A and tightening screw 23, the tightening screw 23 being placed at intervals to match the slots in the base 20A, the constraining assembly 21A being threaded, allowing the tightening screw 23 to be loosened and the assembly slid outward off the slotted base 20A, thereby releasing the watercolor paper for removal.

To explain the constrainer and its use, the following procedure in sequence is given for the preferred design using the slotted constraining strap shown in FIGS. 1 and 2.

1. The screws are loosened and the slotted constraining straps are slidably removed from the base.
2. The industry-standard size watercolor paper is soaked in water for a sufficient amount of time to allow it to expand to the fullest extent.
3. The watercolor paper is then placed on the base with its edges equally spaced from the tightening screws.
4. The constraining straps are then slid into position to effect an edge-line constraint, and the screws are then tightened.

The following procedure is given for the alternate design using the constraining assembly shown in FIG. 3.

1. The screws are loosened and the constraining assemblies are slidably removed from the edge-slotted base.
2. The industry-standard size watercolor paper is soaked in water for a sufficient amount of time to allow it to expand to the fullest extent.
3. The watercolor paper is then placed on the base with its edges equally spaced from the edge slots.
4. The constraining assemblies are then slid into position to effect an edge-line constraint, and the screws are then tightened.

From this point in the procedure, painting may proceed immediately with the watercolor paper wet, or when completely dry, or during any sequence of wetting or drying without experiencing the unacceptable hills and valleys on the watercolor paper surface.

Upon reading the sequence of procedures above it should be noted that this watercolor paper constrainer does not literally stretch watercolor paper, but that it constrains, and prevents the watercolor paper from dimensionally contracting in length and width after it has been expanded with water, thereby maintaining a flat watercolor paper sheet throughout its full surface, with full-format size.

What is claimed is:

1. A watercolor paper constrainer comprising a rectangular base having a plurality of tightening screws permanently mounted along each of the sides of the base to each slidably receive an open slotted constraining strap, each strap containing a plurality of slots with the openings intersecting an edge of the constraining strap, wherein the screws extend above the surface of said base sides allowing the slidable insertion and adjustment of the slotted constraining straps, and wherein said slotted constraining straps are substantially equal in length to the length of each of said sides, said adjustment of the constraining straps allowing for their precise positioning for edge-line constraint of the watercolor paper to obtain full-format flatness thereof.

2. A watercolor paper constrainer having a rectangular base and a plurality of open slots along each of the sides of the base and the opening for each slot intersecting an edge of the base, and a plurality of constraining assemblies each consisting of a lower bar and an upper constraining strap both loosely joined by a plurality of screws spaced to be slidably and adjustably inserted into the slots, wherein the inside edges of the constraining straps adjacent to the sides forming a edge-line constraint of the watercolor paper, thereby obtaining a full-format flatness thereof.

* * * * *